US008926375B2

(12) United States Patent
Chen

(10) Patent No.: US 8,926,375 B2
(45) Date of Patent: Jan. 6, 2015

(54) POWER CONNECTOR

(71) Applicant: Oupiin Electronic (Kunshan) Co., Ltd, Kunshan, Jiangsu (CN)

(72) Inventor: Hsin Chih Chen, Jiangsu (CN)

(73) Assignee: Oupiin Electronic (Kunshan) Co., Ltd, Kunshan, Jiangsu (CN)

( * ) Notice: Subject to any disclaimer, the term of this patent is extended or adjusted under 35 U.S.C. 154(b) by 0 days.

(21) Appl. No.: 14/020,915

(22) Filed: Sep. 9, 2013

(65) Prior Publication Data

US 2014/0141656 A1 May 22, 2014

(30) Foreign Application Priority Data

Nov. 19, 2012 (CN) ..... 2012 1 0467185

(51) Int. Cl.
*H01R 13/26* (2006.01)
*H01R 12/70* (2011.01)

(52) U.S. Cl.
CPC ..... *H01R 13/26* (2013.01); *H01R 12/7088* (2013.01); *Y10S 439/908* (2013.01)
USPC ..... 439/682; 439/79; 439/908

(58) Field of Classification Search
USPC ..... 439/79, 511, 682, 907, 908
See application file for complete search history.

(56) References Cited

U.S. PATENT DOCUMENTS

| | | | | |
|---|---|---|---|---|
| 5,735,715 | A * | 4/1998 | Olson | 439/682 |
| 6,394,818 | B1 * | 5/2002 | Smalley, Jr. | 439/79 |
| 6,471,523 | B1 * | 10/2002 | Shuey | 439/63 |
| 7,001,189 | B1 * | 2/2006 | McGowan et al. | 439/79 |
| 7,104,812 | B1 * | 9/2006 | Bogiel et al. | 439/79 |
| 8,057,266 | B1 * | 11/2011 | Roitberg | 439/682 |
| 8,366,458 | B2 * | 2/2013 | Ngo et al. | 439/79 |
| 8,574,015 | B2 * | 11/2013 | Tai et al. | 439/682 |
| 8,821,184 | B2 * | 9/2014 | Yu et al. | 439/512 |
| 2009/0088028 | A1 * | 4/2009 | Ngo et al. | 439/682 |
| 2014/0141656 | A1 * | 5/2014 | Chen | 439/682 |

* cited by examiner

*Primary Examiner* — James Harvey
(74) *Attorney, Agent, or Firm* — Soroker-Agmon

(57) ABSTRACT

A power connector is provided in the present invention, including an insulative body and four conductive terminals. The shape of insulation housing is an upright rectangle. Each conductive terminal includes an upright base plate, a plate-shaped contact portion and multiple tails. The plate-shaped contact portions of the first and the second conductive terminals together form one upright contact plane, and the plate-shaped contact portions of the third and the fourth conductive terminals together form the other upright contact plane. The two contact planes are respectively against two sides of a center plate of the insulative body, thereby improving an electrical connection performance. The insulative body of the power connector of the present invention defines a terminal-mounting space, and the four conductive terminals are combined to the insulative body by assembling for efficiently improving a heat-dissipating performance.

9 Claims, 9 Drawing Sheets

POWER CONNECTOR

BACKGROUND OF THE INVENTION

1. Field of the Invention

The present invention relates to a connector technical field, and particularly relates to a power connector.

2. Description of Prior Art

As the electronic industry is developing. The internal power supply demand of all kinds of electronic devices and systems is in constant growth, and the stability requirement of the power supply is increasingly high as well. For the purpose of ensuring a sustained power supply, the power connector is required to have a reliable mechanical connection structure. In practical application, compared to the connector for signal transmission, the power connector for power transmission is more likely to encounter needs for relatively frequent plugging and unplugging, therefore, in terms of mechanical performance (e.g. durability and life), the requirements for the power connector for power transmission is even stricter.

Currently, the conductive terminals of power connectors used in the industry are primarily plate-shaped and the receptacle terminals of receptacle connectors are finger-shaped and are bent and resilient, by the contact of the resilient finger-shaped receptacle terminal and the plate-shaped conductive terminal, the power transmission is carried out. Nevertheless, by simply electrically connect the plate-shaped conductive terminal to the finger-shaped receptacle terminal, the applicability is limited. For instance, the tails of the conductive terminals are required to correspond to the power access point on the circuit board one by one, therefore, the plate-shaped conductive terminal is unable to meet the arrayed layout of various power access points and is required to be altered into a multi-plates shape. Yet, if the plate-shaped conductive terminal is altered into multi-plates such as three or four-plates, a number of technical problems will happen, for example, a false connection is very likely to occur during the docking of the conductive terminal and the receptacle terminal.

Furthermore, the plate-shaped conductive terminals of the power connectors currently used in the industry are combined to the insulative body by integrating and are easily to encounter bad heat.

Therefore, in the light of the defects and inconvenience in the structure of conventional power connector above-mentioned, the inventor proposed a new power connector is required to properly optimize the structure, improve the electrical connection performance, and effectively improve heat dissipation, thereby resolving the problems in the conventional technology as mentioned above.

SUMMARY OF THE INVENTION

One objective of the present invention is to provide a power connector that is operable to improve the reliability of an electrical connection and heat dissipation.

Other objectives and advantages of the present invention are described in detail from the technical features disclosed in the present invention.

To attain the objectives, a solution provided by the present invention is: A power connector which comprises an insulative body, a first conductive terminal, a second conductive terminal, a third conductive terminal and a forth conductive terminal; the shape of the insulative body is an upright rectangle, the insulative body comprises a docking section disposed on the front and a mounting section disposed on the rear, the front surface of the docking section is perpendicular to the bottom surface of the mounting section; an inserting slot is formed in the front surface of the docking section of the insulative body, the inserting slot is extending inward to form an accommodating chamber, central of the accommodating chamber is disposed with a central plate protruding and upright;

each of the conductive terminal is provided with an upright base plate having a first side and a second side, a plate-shaped contact portion bent and extending forward from the first side of the base plate, and a plurality of tails extending downward from the second side of the base plate, wherein the first side of the base plate is perpendicular to the second side, the base plates of the conductive terminals are parallel and perpendicular to the mounting section of the insulative body, the plate-shaped contact portions are extended into the accommodating chamber of the insulative body, the tails are extended out of the bottom surface of the insulative body; wherein the plate-shaped contact portion of the first conductive terminal is bent toward the second conductive terminal and then extending forward and the plate-shaped contact portion of the second conductive terminal is bent toward the first conductive terminal and then extending forward, and the plate-shaped contact portion of first conductive terminal and the plate-shaped contact portion of second conductive terminal are ranged straight in line up and down and form an upright contact plane jointly, and the plate-shaped contact portions of the first conductive terminal and second conductive terminal closely against the other side of the central plate; and the plate-shaped contact portion of the third conductive terminal is bent toward the forth conductive terminal and then extending forward and the plate-shaped contact portion of the forth conductive terminal is bent toward the third conductive terminal and then extending forward, and the plate-shaped contact portion of third conductive terminal and the plate-shaped contact portion of forth conductive terminal are ranged straight in line up and down and form an upright contact plane jointly, and the plate-shaped contact portions of the third conductive terminal and forth conductive terminal closely against the other side of the central plate.

In one embodiment of the present invention, a terminal-mounting space passing through the bottom surface and rear surface of mounting section, and a plurality of terminal accommodating passages connecting the terminal-mounting space and the accommodating chamber are defined in the mounting section of the insulative body, and the base plate of each of the conductive terminals is parallel fixed into the corresponding terminal accommodating passage.

In one embodiment of the present invention, the first conductive terminal and the forth conductive terminal are symmetrical in structure and the second conductive terminal and the third conductive terminal are symmetrical in structure.

In one embodiment of the present invention, the plate-shaped contact portion of the first conductive terminal is bent toward the second conductive terminal and extending forward from the upper half of the first side of the base plate of the first conductive terminal; and the plate-shaped contact portion of the second conductive terminal is bent toward the first conductive terminal and extending forward from the lower half of the first side of the base plate of the second conductive terminal.

In one embodiment of the present invention, the bending direction of the plate-shaped contact portion of the third conductive terminal is opposite to that of the plate-shaped contact portion of the second conductive terminal; the plate-shaped portion of the third conductive terminal is bent toward the forth conductive terminal and extending forward from the lower half of the first side of the base plate of the third conductive terminal.

In one embodiment of the present invention, the bending direction of the plate-shaped contact portion of the forth conductive terminal is opposite to that of the plate-shaped contact portion of the first conductive terminal; the plate-shaped portion of the forth conductive terminal is bent toward the third conductive terminal and extending forward from the upper half of the first side of the base plate of the forth conductive terminal.

In one embodiment of the present invention, the base plate of the first conductive terminal is disposed with a plurality of protrusions.

In one embodiment of the present invention, a positioning rod is formed on the bottom surface of the mounting section of the insulative body and is adjacent to the docking section.

In one embodiment of the present invention, an upright spacer is formed between neighboring accommodating passages.

Compared to conventional technologies, by dividing the plate-shaped contact portions of the four conductive terminals into two group and forming a two vertical contact planes that are respectively against the two sides of the central plate, the power connector according to the present invention defines an electrical structure that is complete and stable and is operable to improve the electrical connection performance of the power connector. Besides, as a terminal-mounting space is formed on the mounting section of the insulative body of the power connector, and the four conductive terminals are combined to the insulative body by assembling, accordingly, the heat dissipation of the power connector is effectively improved. Besides, the base plates of the conductive terminal according to the present invention can be secured in a way by both plastic cement and assistant protrusions, so that the structure stability of the power connector is ensured.

DETAILED DESCRIPTION OF THE INVENTION

The following description is explained in conjunction with accompanying drawings to illustrate rather than limit the present invention.

Figure 1:
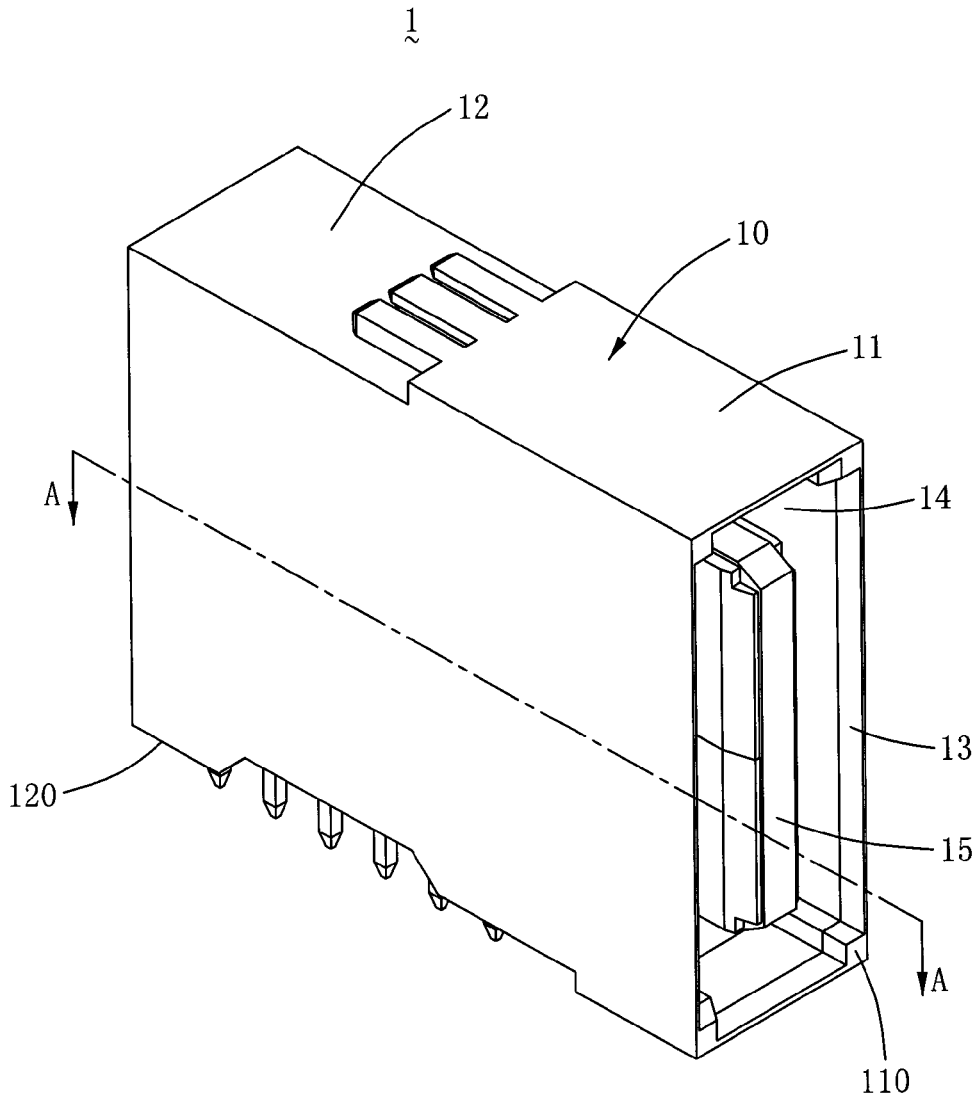
FIG. 1 is a space diagram of the power connector according to the present invention.
Figure 2:
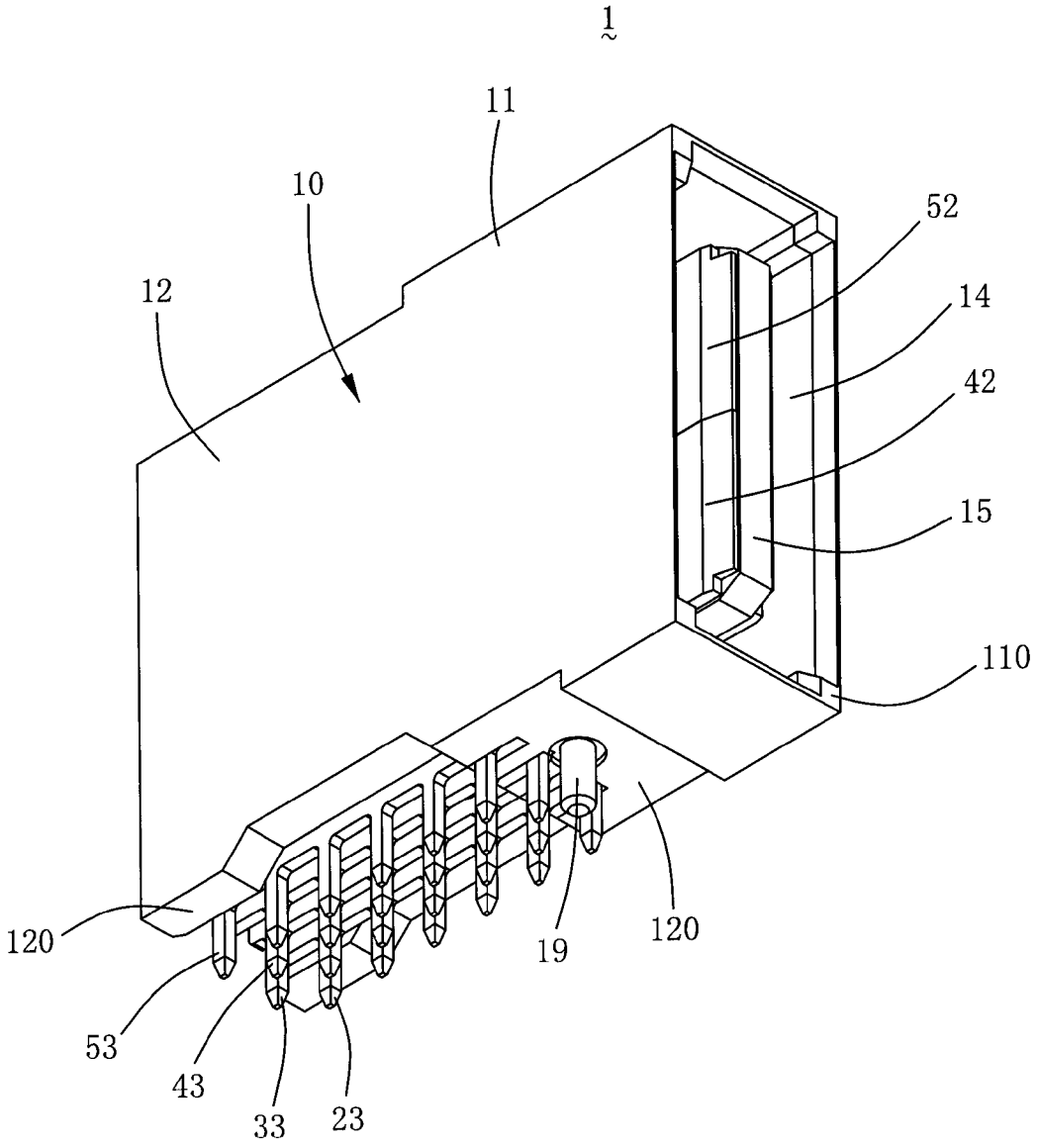
FIG. 2 is a space diagram from another angle of the power connector according to the present invention.
Figure 3:
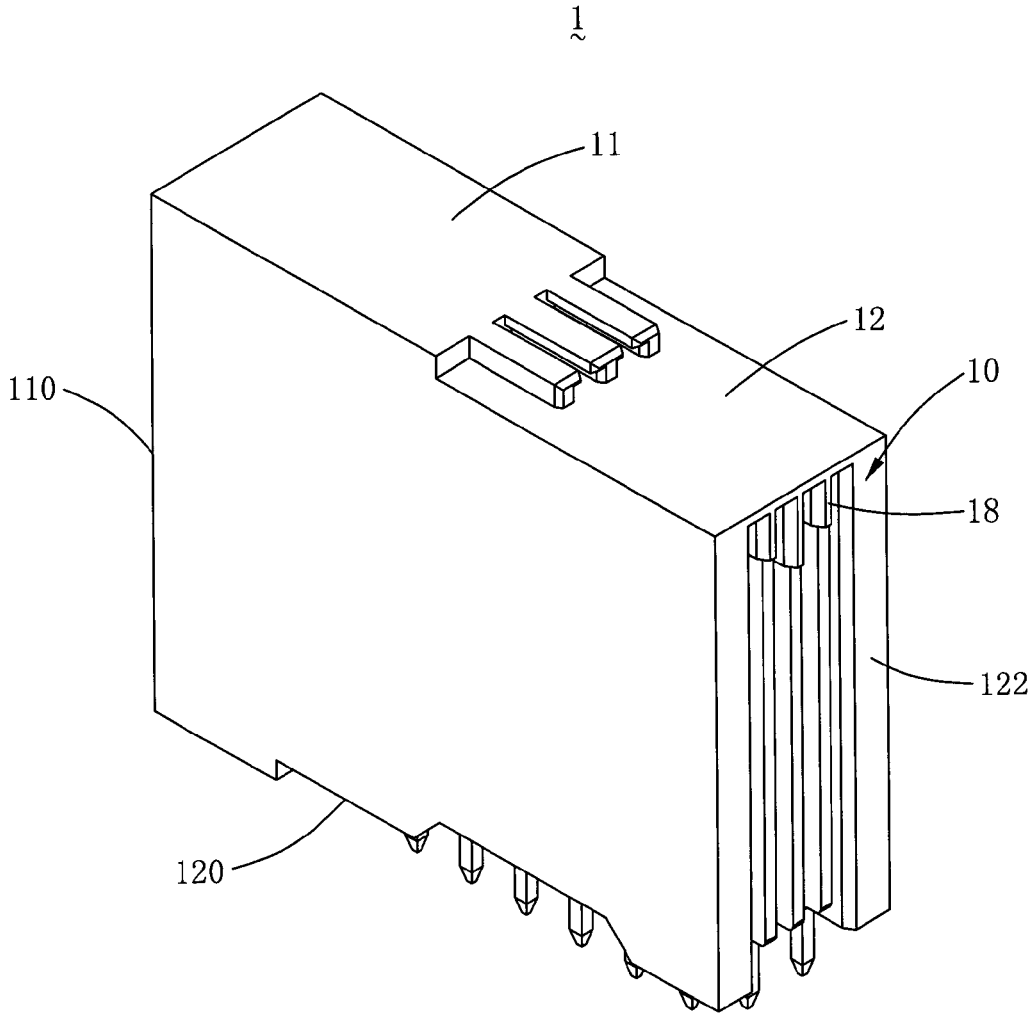
FIG. 3 is a space diagram from a third angle of the power connector according to the present invention.
Figure 4:
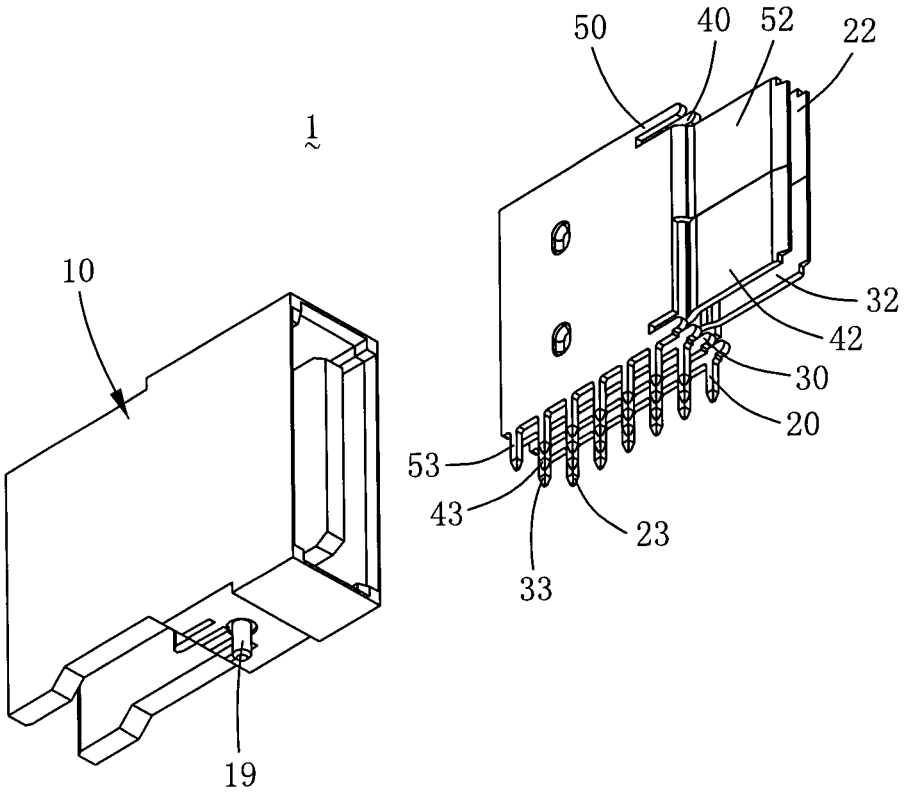
FIG. 4 is an exploded view of the power connector according to the present invention.
Figure 5:
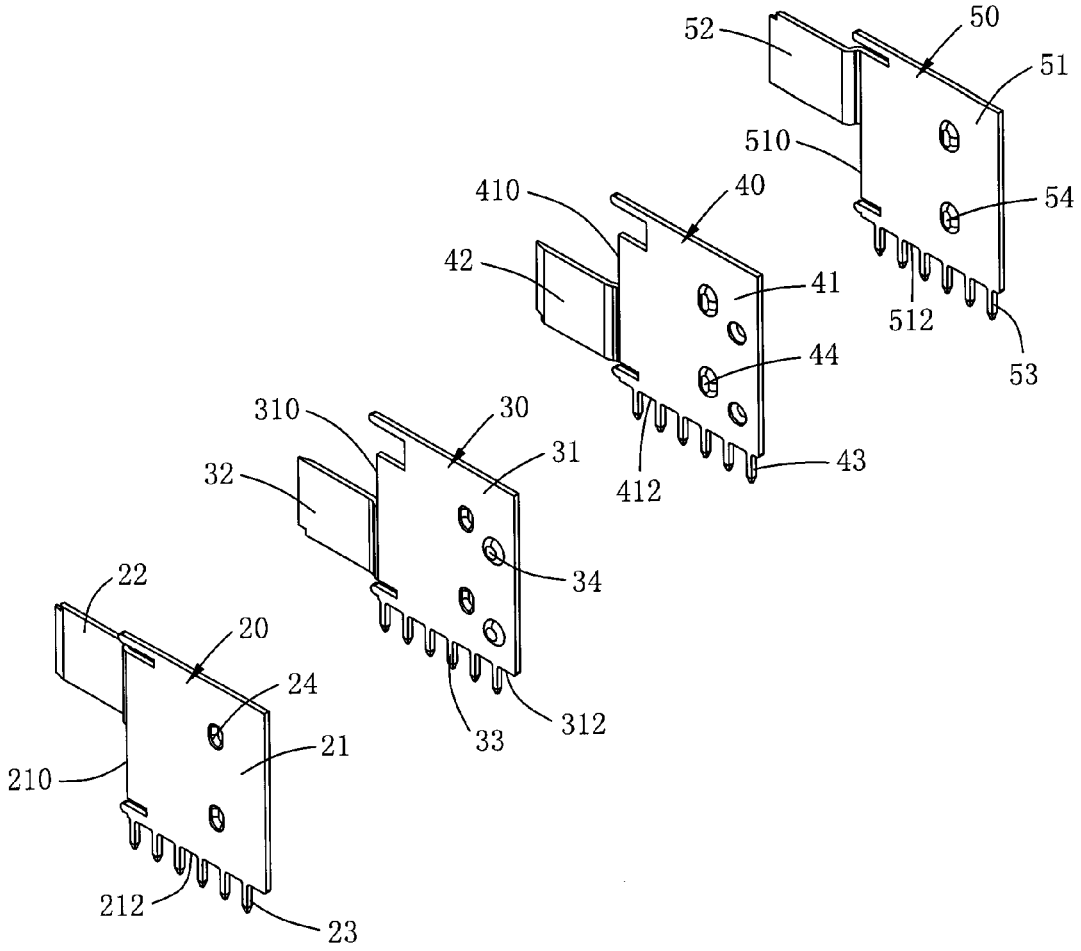
FIG. 5 is a schematic diagram of the conductive terminal of the power connector according to the present invention.
Figure 6:
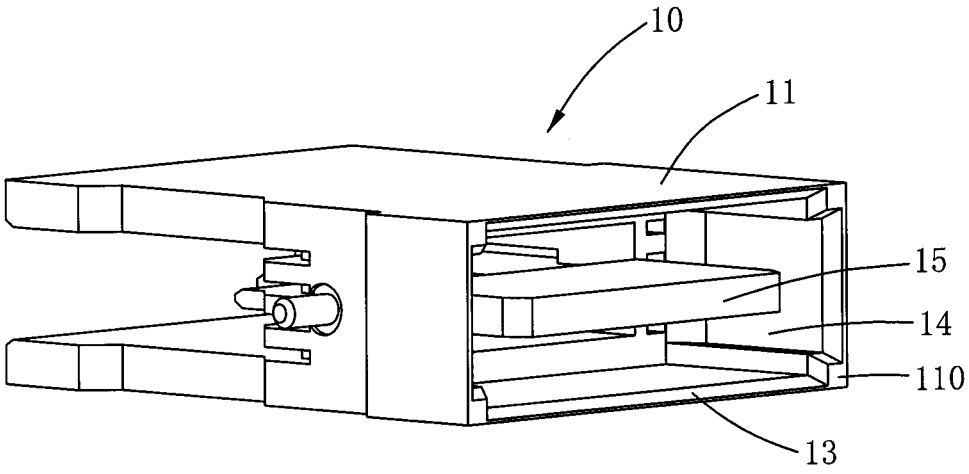
FIG. 6 is a schematic diagram of the insulative body of the power connector according to the present invention.
Figure 7:
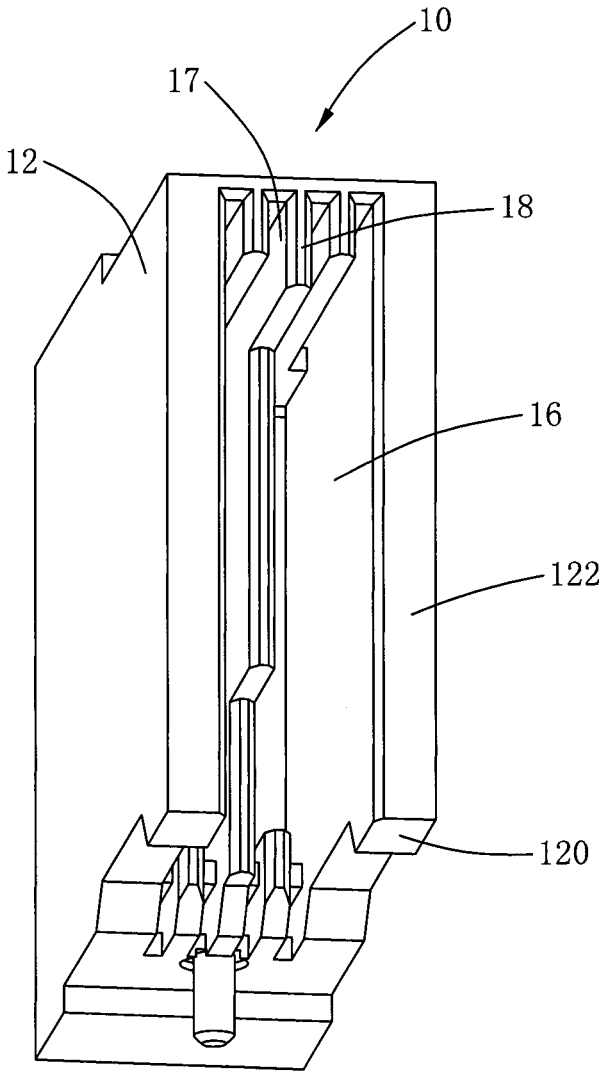
FIG. 7 is a schematic diagram from another angle of the insulative body of the power connector according to the present invention.
Figure 8:
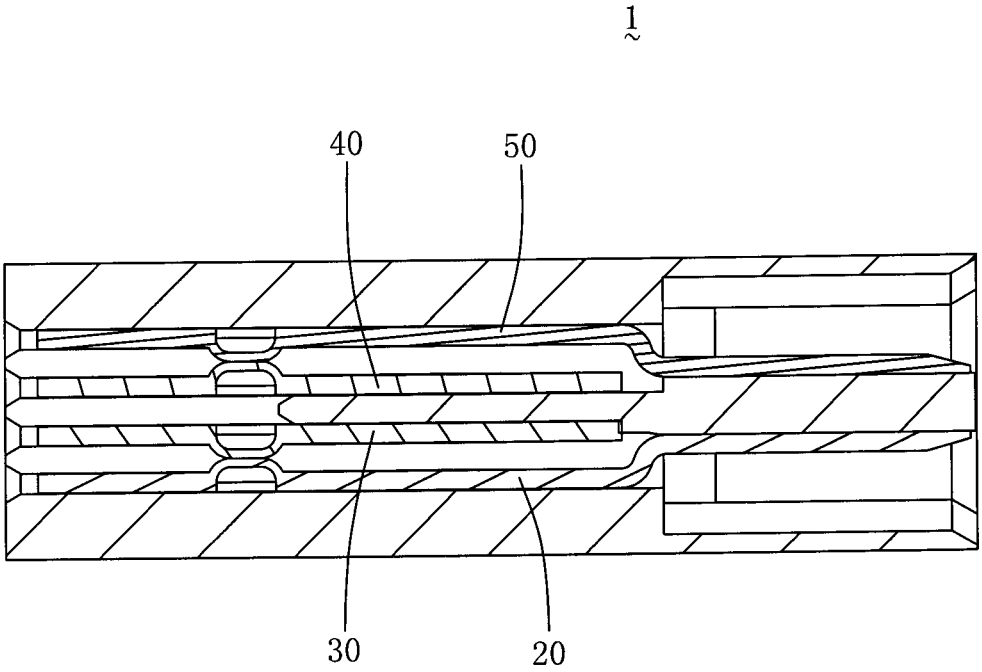
FIG. 8 is a cross-sectional view along A-A according to FIG. 1.

Please refer to the power connector 1 illustrated in FIGS. 1 to 8 according to the present invention, wherein FIG. 1 is the space diagram of the power connector 1 according to the present invention; FIG. 2 is the space diagram of the power connector 1 from another angle according to the present invention; FIG. 3 is the space diagram of the power connector 1 from a third angle according to the present invention; FIG. 4 is an exploded diagram of the power connector 1 according to the present invention; FIG. 5 is a schematic diagram of the conductive terminals of the power connector 1 according to the present invention; FIG. 6 is a schematic diagram of the insulative body 10 of the power connector 1; FIG. 7 is a schematic diagram of the insulative body 10 of the power connector 1 from another angle; and FIG. 8 is a cross-sectional diagram along A-A according to FIG. 1.

The power connector according to the present invention comprises an insulative body 10, a first conductive terminal 20, a second conductive terminal 30, a third conductive terminal 40 and a forth conductive terminal 50.

As illustrated in FIGS. 1 to 3, the shape of the insulative body 10 is generally an upright rectangle which comprises a docking section 11 in the front and a mounting section 12 in the rear, the front surface 110 of the docking section 11 is perpendicular to the bottom surface 120 of the mounting section 12, when the power connector 1 is mounted onto the circuit board 3, the bottom surface 120 of the mounting section 12 is disposed on the circuit board 3 and the docking section 11 and whose front surface 110 are extended out of the edge of the circuit board 3 to be docked with the receptacle connector 2 (please also refer to FIG. 10).

As illustrated in FIGS. 1 and 6, an inserting slot 13 is formed in the front surface of the docking section 11 of the insulative body, which is extending inward to define an accommodating chamber 14 having an upright center plate 15 dispose in the middle.

As illustrated in FIGS. 2, 3 and 7, a terminal-mounting space 16 connecting the bottom surface 120 and rear surface 122 of the mounting section 12, and a plurality of terminal accommodating passages 17 passing through the terminal-mounting space 16 and the accommodating chamber 14 are formed in the mounting section 12 of the insulative body 10. The terminal-mounting space 16 can facilitate the mounting of the conductive terminal and insulative body and is also beneficial to the heat dissipation of the conductive terminal. In the present embodiment, the number of the terminal accommodating passages 17 is equal to that of the conductive terminals 20, 30, 40 and 50, and is also counted four. In the present invention, an upright spacer 18 is formed between the terminal accommodating passages 17, yet in consideration of heat dissipation, the spacer 18 is not formed completely covering the terminal-mounting space 16 but extending a small distance downward.

As illustrated in FIGS. 4 and 5, the first conductive terminal 20, second conductive terminal 30, third conductive terminal 40 and forth conductive terminal 50 are generally of the same structure and are mounted into the insulative body 10 in parallel (please also refer to FIG. 4), wherein the first conductive terminal 20 is symmetrical to the forth conductive terminal 50 and the second conductive terminal 30 is symmetrical to the third conductive terminal 40. During mounting, the first conductive terminal 20 and the second conductive terminal form a first group and the third conductive terminal 40 and forth conductive terminal 50 form a second group. Please refer to the following description for details of the structure.

As illustrated in FIG. 5, the first conductive terminal 20 is provided with an upright base plate 21 having a first side 210 and a second side 212, a plate-shaped contact portion 22 bending and extending forward from the upper half of the first side 210 of the base plate 21, and multiple tails 23 extending downward from the second side 212 of the base plate, wherein the first side 210 is perpendicular to the second side 212 of the base plate 210.

As illustrated in FIG. 5, the first conductive terminal 30 is provided with an upright base plate 31 having a first side 310 and a second side 312, a plate-shaped contact portion 32 bending and extending forward from the lower half of the first side 310 of the base plate 31, and multiple tails 33 extending downward from the second side 312 of the base plate, wherein the first side 310 is perpendicular to the second side 312 of the base plate 31.

As illustrated in FIG. 5, in the present invention, the plate-shaped contact portion 22 of the first conductive terminal 20 is bent toward the second conductive terminal 30 and then extending forward and the plate-shaped contact portion 32 of the second conductive terminal 30 is bent toward the first conductive terminal 20 and then extending forward. Therefore, the plate-shaped contact portion 22 of the first conductive terminal 20 and the plate-shaped contact portion 32 of the second conductive terminal 30 are ranged straight in line up and down, that is, the two contact portions 22, 32 form an upright contact plane jointly, please also refer to FIG. 4.

As illustrated in FIG. 5, the third conductive terminal 40 is structurally symmetrical to the second conductive terminal 30, the third conductive terminal 40 is also provided with an upright base plate 41 having a first side 410 and a second side 412, a plate-shaped contact portion 42 bent and extending forward from the lower half of the first side 410 of the base plate 41, and a plurality of tails 43 extending downward from the second side 412 of the base plate 41, wherein the first side 410 of the base plate 41 is perpendicular to the second side 412. The only difference between the third conductive terminal 40 and the second conductive terminal 30 is that the bending direction of the plate-shaped contact portion 42 of the third conductive terminal 40 is opposite to that of the plate-shaped contact portion 32 of the second conductive terminal 30.

As illustrated in FIG. 5, the forth conductive terminal 50 is structurally symmetrical to the first conductive terminal 20, the forth conductive terminal 50 is also provided with an upright base plate 51 having a first side 510 and a second side 512, a plate-shaped contact portion 52 bent and extending forward from the lower half of the first side 510 of the base plate 51, and a plurality of tails 53 extending downward from the second side 512 of the base plate 51, wherein the first side 510 of the base plate 51 is perpendicular to the second side 512. The only difference between the forth conductive terminal 50 and the first conductive terminal 20 is that the bending direction of the plate-shaped contact portion 52 of the forth conductive terminal 50 is opposite to that of the plate-shaped contact portion 32 of the first conductive terminal 20.

As illustrated in FIG. 5, in the present invention, the plate-shaped contact portion 42 of the third conductive terminal 40 is bent toward the forth conductive terminal 50 and then extending forward and the plate-shaped contact portion 52 of the forth conductive terminal 50 is bent toward the third conductive terminal 40 and then extending forward, thereby making the plate-shaped contact portion 42 of the third conductive terminal 40 and the plate-shaped contact portion 52 of the forth conductive terminal 50 to be ranged straight in line up and down and form another upright contact plane jointly (please also refer to FIG. 4 and FIG. 2).

As illustrated in FIGS. 2 and 4, during assembling, all the base plates 21, 31, 41, 51 of the first to forth conductive terminals 20, 30, 40, 50 are assembled to the mounting section 12 of the insulative body 10 in parallel, having the plate-shaped contact portions 22, 32, 42, 52 extended into the accommodating chamber 14 of the docking section 11 of the insulative body 10 and the tails 23, 33, 43, 53 extended out of the bottom surface 120 of the mounting section 12. More particularly, the plate-shaped contact portions 22, 32 of the first conductive terminal 20 and second conductive terminal 30 closely against the other side of the central plate 15 and the plate-shaped contact portions 42, 52 of the third conductive terminal 40 and the forth conductive terminal 50 closely against another side of the central plate 15.

Please refer to FIGS. 5 and 8, a plurality of protrusions 24, 34, 44, 54 are disposed on the base plate 21, 31, 41, 51 of the conductive terminals 20, 30, 40, 50 to provide assistant fixing. For example, the protrusions 24, 34, 44, 54 are against each other to keep the space between adjacent terminals to prevent the first to forth conductive terminals 20, 30, 40, 50 from distortion during assembling and using.

Additionally, a positioning rod (please refer to FIG. 2 and FIG. 4) to secure the power connector 1 and prevent the power connector 1 from inclining backward during the docking with receptacle connector 2, thereby guaranteeing the stability of the electrical connection between the power connector 1 and the circuit board 3.

Figure 9:
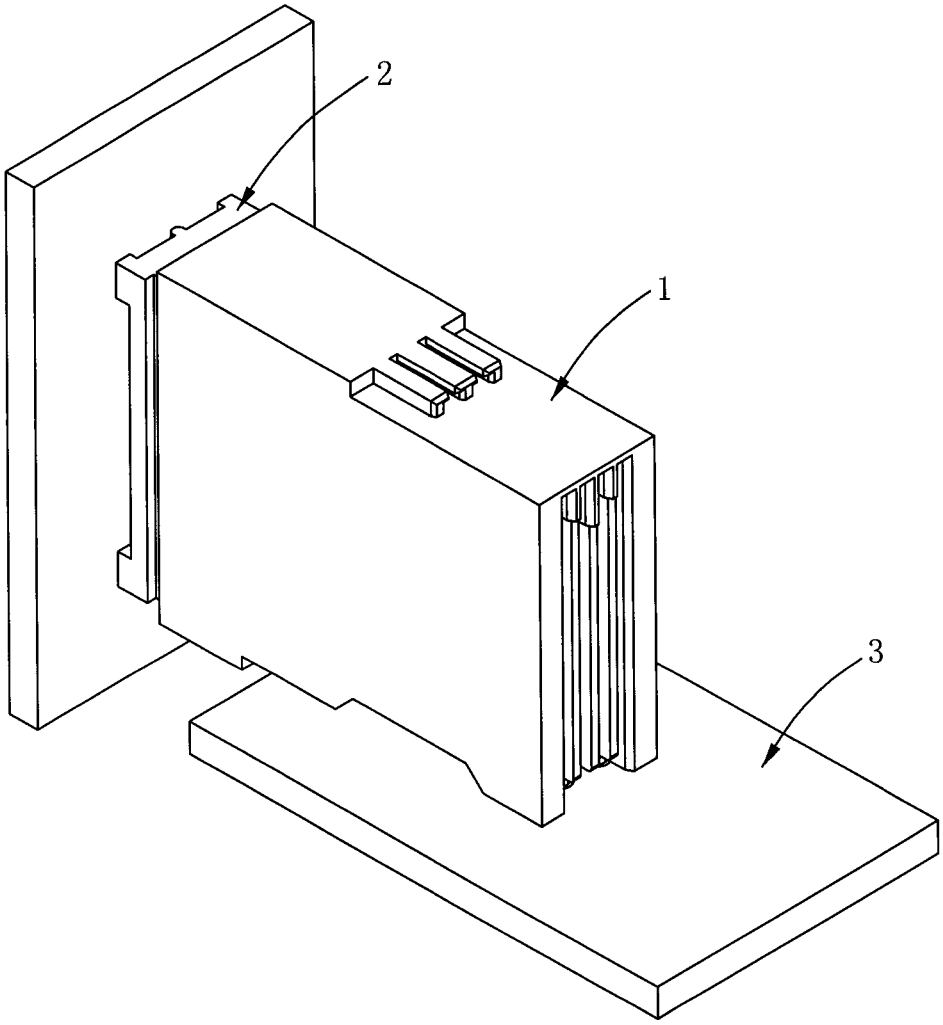
FIG. 9 is a spatial relationship diagram of the power connector and receptacle connector after docking.

Please refer to FIG. 9, the power connector 1 according to the present invention is right-angled and being parallel mounted onto the circuit board 3, that is, the inserting direction of the power connector 1 to the receptacle connector 2 is parallel to the circuit board 3. During docking, the central plate 15 (please also refer to FIG. 1)*of* the power connector 1 is inserted into the receptacle connector 2 and the conductive terminals at both sides of the central plate 15 form an electrical connection with the receptacle terminals.

All in all, by dividing the plate-shaped contact portions 22, 32, 42, 52 of the four conductive terminals 20, 30, 40, 50 into two group and forming a two vertical contact planes that are respectively against the two sides of the central plate 15, the power connector 1 according to the present invention defines an electrical structure that is complete and stable and is operable to improve the electrical connection performance of the power connector 1 according to the present invention. Besides, as a terminal-mounting space 16 is formed on the mounting section 12 of the insulative body 10 of the power connector 1, and the four conductive terminals 20, 30, 40, 50 are combined to the insulative body by assembling, accordingly, the heat dissipation of the power connector is effectively improved. Besides, the base plates 21, 31, 41, 51 of the conductive terminal according to the present invention can be secured in a way by both plastic cement and assistant protrusions, so that the structure stability of the power connector is ensured.

What is claimed is:

1. A power connector comprising an insulative body, a first conductive terminal, a second conductive terminal, a third conductive terminal and a forth conductive terminal; wherein the shape of the insulative body is an upright rectangle, the insulative body comprises a docking section disposed on the front and a mounting section disposed on the rear, a front surface of the docking section is perpendicular to a bottom surface of the mounting section; an inserting slot is formed in the front surface of the docking section of the insulative body, the inserting slot is extending inward to form an accommodating chamber, central of the accommodating chamber is disposed with a central plate protruding and upright;

each of the conductive terminals is provided with an upright base plate having a first side and a second side, a plate-shaped contact: portion bent and extending forward from the first side of the base plate, and a plurality of tails extending downward from the second side of the base plate, wherein the first side of the base plate is perpendicular to the second side, the first side of each of the base plates of the conductive terminals are parallel to each other and the first side of each of the base plates are perpendicular to the mounting section of the insulative body, the plate-shaped contact portions are extended into the accommodating chamber of the insulative body, the tails are extended out of the bottom surface of the insulative body; wherein the plate-shaped contact portion of the first conductive terminal is bent toward the second conductive terminal and then extending forward and the plate-shaped contact portion of the second conductive terminal is bent toward the first conductive terminal and then extending forward, and the plate-shaped contact portion of first conductive terminal and the plate-shaped contact portion of second conductive terminal are ranged straight in line up and down and form an upright contact plane jointly, and the plate-shaped contact portions of the first conductive terminal and second conductive terminal closely against the other side of the central plate; and the plate-shaped contact portion of the third conductive terminal is bent toward the forth conductive terminal and then extending forward and the plate-shaped contact portion of the forth conductive terminal is bent toward the third conductive terminal and then extending forward, and the plate-shaped contact portion of third conductive terminal and the plate-shaped contact portion of forth conductive terminal are ranged straight in line up and down and form an upright contact plane jointly, and the plate-shaped contact portions of the third conductive terminal and forth conductive terminal closely against the other side of the central plate.

2. The power connector as claimed in claim 1, wherein a terminal-mounting space passing through the bottom surface and rear surface of mourning section, and a plurality of terminal accommodating passages connecting the terminal-mounting space and the accommodating chamber are defined in the mounting section of the insulative body, and the base plate of each of the conductive terminals is parallelly fixed in the corresponding terminal accommodating passage.

3. The power connector as claimed in claim 1, wherein the first conductive terminal and the forth conductive terminal are symmetrical in structure and the second conductive terminal and the third conductive terminal are symmetrical in structure.

4. The power connector as claimed in claim 3, wherein the plate-shaped contact portion of the first conductive terminal is bent toward the second conductive terminal and extending forward from the upper half of the first side of the base plate of the first conductive terminal; and the plate-shaped contact portion of the second conductive terminal is bent toward the first conductive terminal and extending forward from the lower half of the first side of the base plate of the second conductive terminal.

5. The power connector as claimed in claim 4, wherein the bending direction of the plate-shaped contact portion of the third conductive terminal is opposite to that of the plate-shaped contact portion of the second conductive terminal; the plate-shaped portion of the third conductive terminal is bent toward the forth conductive terminal and extending forward from the lower half of the first side of the base plate of the third conductive terminal.

6. The power connector as claimed in claim 5, wherein the bending direction of the plate-shaped contact portion of the forth conductive terminal is opposite to that of the plate-shaped contact portion of first conductive terminal; the plate-shaped portion of the forth conductive terminal is bent toward the third conductive terminal and extending forward from the upper half of the first side of the base plate of the forth conductive terminal.

7. The power connector as claimed in claim 1, wherein the base plate of the first conductive terminal is disposed with a plurality of protrusions.

8. The power connector as claimed in claim 1, wherein a positioning rod is formed on the bottom surface of the mounting section of the insulative body and is adjacent to the docking section.

9. The power connector as claimed in claim 2, wherein an upright spacer is formed between adjacent accommodating passages.

* * * * *